United States Patent [19]

Meyer

[11] 3,952,718

[45] Apr. 27, 1976

[54] STARTER APPARATUS FOR INTERNAL COMBUSTION ENGINES

[75] Inventor: James A. Meyer, Oshkosh, Wis.

[73] Assignee: Brunswick Corporation, Skokie, Ill.

[22] Filed: Aug. 12, 1974

[21] Appl. No.: 496,882

[52] U.S. Cl. ..... 123/179 SE; 123/185 CA

[51] Int. Cl.[2] ..... F02N 17/00

[58] Field of Search.... 123/179 SE, 185 B, 185 CA, 123/185 A

[56] References Cited

UNITED STATES PATENTS

| | | | |
|---|---|---|---|
| 2,480,550 | 8/1949 | Catlin | 123/185 LA |
| 2,564,787 | 8/1951 | Mack | 123/179 SE |
| 2,938,511 | 5/1960 | Pike et al. | 123/185 B |
| 3,044,238 | 7/1962 | Harkness | 123/185 CA |
| 3,306,277 | 2/1967 | Godmundsen | 123/179 SE |
| 3,332,410 | 7/1967 | Dwyer | 123/179 SE |
| 3,824,979 | 7/1974 | Tajika et al. | 123/185 A |

*Primary Examiner*—Charles J. Myhre
*Assistant Examiner*—James D. Liles
*Attorney, Agent, or Firm*—Andrus, Sceales, Starke & Sawall

[57] ABSTRACT

A rewind type starter apparatus for an outboard motor is mounted on the side of an internal combustion engine having an inverted cup-shaped flywheel secured to the upper end of the engine crankshaft. A protective cowl encloses the engine, starter and other engine components. The starter apparatus includes a mounting plate bolted to the engine block through a pivot tab and slotted pivot openings. A coiled, flat spring encircles a helical shaft attached to a rope sheave and rotatably mounted on a fixed pin extending laterally of the bracket and engine. A rope is wound within a groove in the sheave which is spring-loaded to the wound position. The outer end of the rope extends outwardly from the lower periphery of the rope sheave to the front of the cowl. A pinion gear includes a hub member located on the shaft with an internal complementing helix drive between the shaft and hub. A cap holds the shaft on the pin and limits the outward movement of the pinion gear to engagement with a driven gear formed on an inner portion of the lower edge of the flange of the fly-wheel. A small guide pin is located within an opening in the pinion gear with a U-shaped clip frictionally, slidably located within a peripheral groove in the cap to slightly retard gear rotation and effect lateral movement of the pinion gear into, and out of, contact with the driven gear.

21 Claims, 5 Drawing Figures

Fig. 1
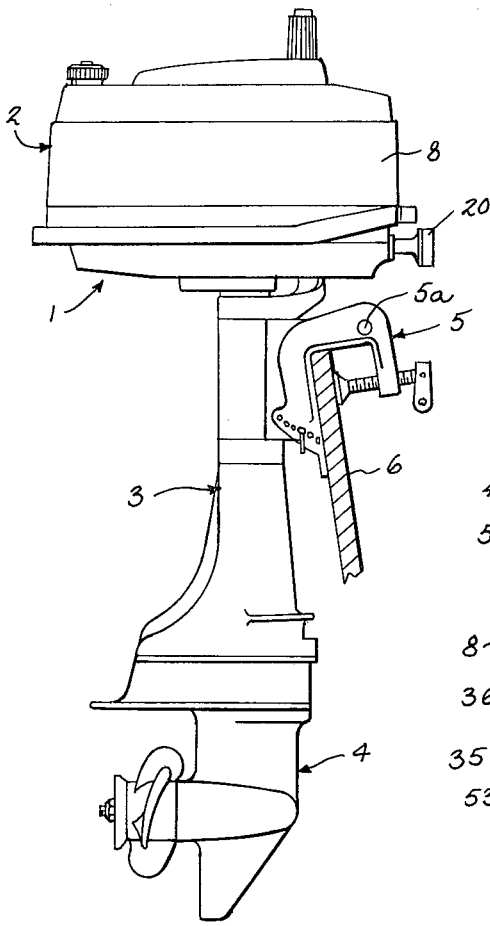
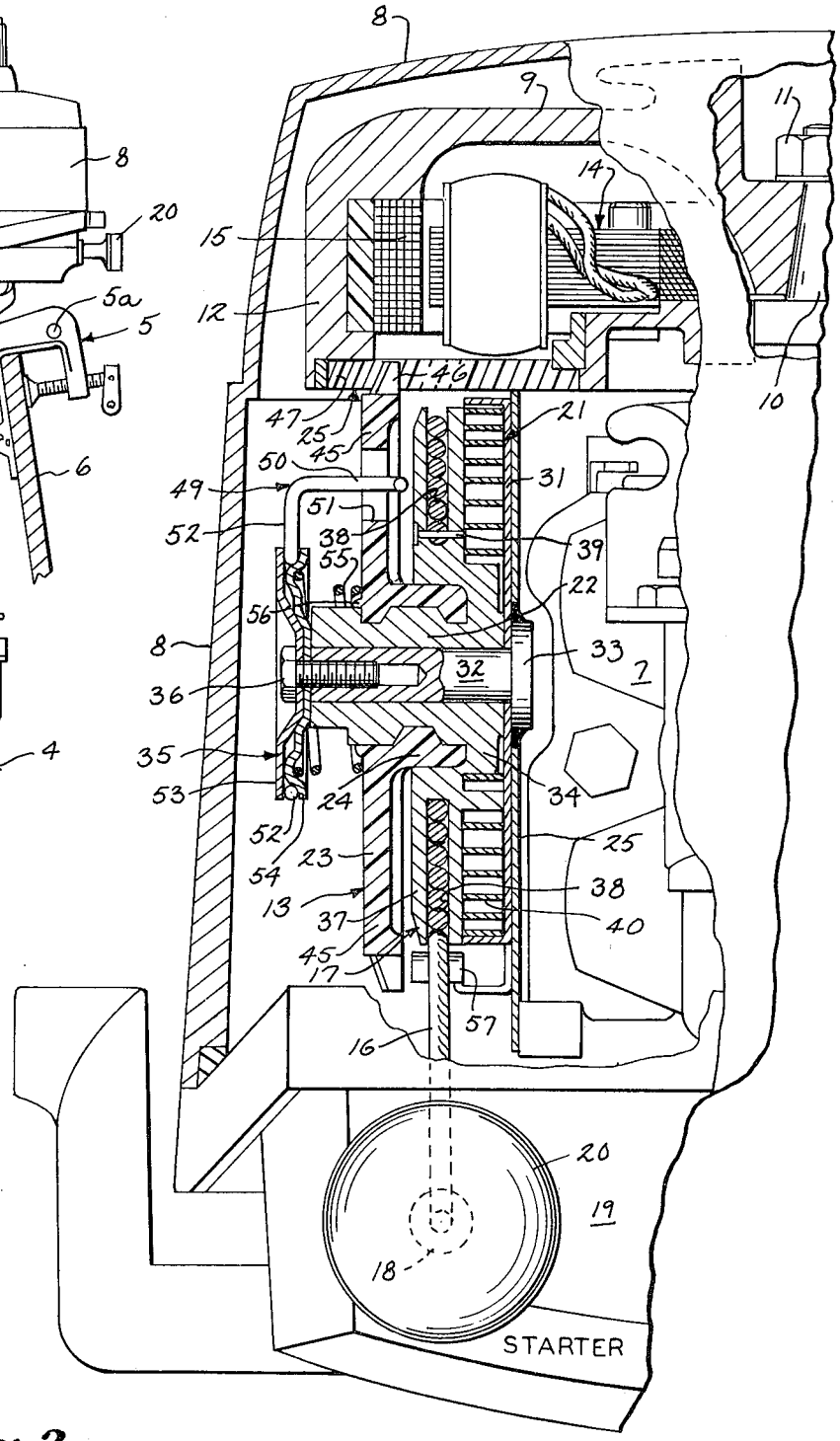
Fig. 2

STARTER APPARATUS FOR INTERNAL COMBUSTION ENGINES

BACKGROUND OF THE INVENTION

The present invention relates to a starter apparatus for an internal combustion engine and particularly to a manually operated starter apparatus for a small engine forming a part of an outboard motor, a snowmobile, lawn mower, or recreational apparatus.

Internal combustion engines are conventionally started by positively initiating the rotation of the engine. An electric starter apparatus may be employed. Generally a suitable electric starter motor is coupled to a helix coupler which drives a pinion gear into engagement with a flywheel supported gear. Although such electric starter apparatus is widely employed, they do significantly increase the cost of the internal combustion engine mechanism. Consequently, manual starting apparatus is also widely employed, particularly for smaller engines. Outboard motors, snowmobiles and the like in particular may be constructed with relatively low horsepower drive means and employ corresponding small internal combustion engines housed within a decorative and protective cowl. Outboard motors of the order of four horsepower, for example, conveniently employ internal combustion engines which can be started by rotation of the engine through a manually operative rewind starter apparatus. Conventionally, the starter apparatus includes a spring-loaded, pull-rope driven mechanism coupled to the rotating drive means secured to the upper end of the engine such as the flywheel assembly for spinning of the engine. The operator manually, rapidly pulls the rope outwardly to turn the engine over during starting thereof. A suitable one-way drive system couples the rope mechanism to the engine to transmit the starting motion to the engine while automatically disengaging of the rope mechanism as the engine starts and the rotation of the crank and interconnected flywheel increases or becomes significantly more rapid than that of the rope activated mechanism. A coil spring unit is coupled to the rope driven mechanism to automatically rewind the rope, when released.

Although such systems are completely satisfactory, they do incorporate certain disadvantages, particularly when applied to outboard motors and the like. The mounting of the unit to the upper end of the engine requires increasing the overall height of the assembly and the outer protective cowling. Although such structure does not affect the operational characteristics of the engine, a minimum profile may be desired for esthetic purposes.

Further, the rope unit is normally exposed adjacent to the upper end of the engine with a resulting maximum tilt force on the motor assembly as such. The outboard motor is normally mounted to the transom by a suitable swivel bracket assembly located immediately beneath the powerhead unit. The top mounting of the rope produces a significant moment arm with respect to the swivel brackets which may result in tilting of the motor when starting. Although various guide arrangements can be provided to lower the point of force application relative to the swivel axis, such structure further increases the complexity of the starting mechanism as well as introducing possible points of failure. The top mounted starter units, further, are not particularly adapted to certain conventional small outboard motor applications such as larger sailboats. Conventionally, a sailboat of any significant size is provided with an auxiliary engine to permit movement in the event of wind failure or loss of sailing capability. In many larger sailboats, a small outboard motor is mounted within a well in the aft portion of the sailboat. The conventional outboard motor starter is not conveniently located for a vertical upward pull and thus is difficult to operate, or requires special adaptation of the well and/or rope guide mechanism.

Further, when the cowl is removed from the conventional top mounted assembly, the total starting mechanism and particularly gearing system is essentially completely exposed. This may create a possible dangerous environment if the operator or some equipment should engage the gears during motor starting.

Thus, although the conventional rewind starter mechanism and the like has been widely employed and produced satisfactory starting means, Applicant's analysis of such prior art systems has shown certain practical disadvantages.

SUMMARY OF THE PRESENT INVENTION

The present invention is directed to an improved starting apparatus for internal combustion engines and particularly provides a novel side-mounted rewind type starter apparatus. Generally, in accordance with the present invention, the starting apparatus or means is secured to the side of the engine and includes a drive member moving on a generally horizontal or lateral axis for selective movement into and release from drive engagement with the driven starter element such as the flywheel on the engine crankshaft. More particularly, in a practical construction, a pinion gear means as the drive member is coupled to a rope-driven shaft means by a helix or spiral drive coupling means for selective positioning of the pinion gear means into and from engagement with a gear member formed on the underside of a flywheel flange. A spring-loaded sheave is secured to the shaft means for manually rotating thereof and forcing of the pinion gear outwardly to the drive position. The location of the starter apparatus adjacent the side of the engine permits reduction in the overall vertical depth of the unit without significantly increasing the width of the assembly. Further, with this construction applied to an outboard motor, the rope can be extended outwardly in alignment with the lower portion of the engine and thus much closer to the pivot mounting of the outboard motor. However, if the outboard motor is mounted in a well structure of a sailboat or the like, the rope can be rearranged conveniently to allow upward or vertical pulling movement of the starter rope for convenient starting operation. Further, in many instances, maintenance or service work is more convenient on the side mounted starter mechanism particularly when compared to other starter mechanisms which have been concentrically mounted underneath a cup-shaped flywheel assembly.

More particularly, in accordance with a particularly novel and practical construction of the present invention for outboard motors having an internal combustion engine with an inverted-cup-shaped flywheel, the starter assembly includes a mounting bracket means having an adjustable mounting means such as appropriate slot means to permit slight eccentric adjustment of the pinion gear for optimum positioning relative to the flywheel face gear for backlash adjustment. The bracket means is bolted or otherwise affixed to the engine block. A spring-loaded rope sheave has a shaft rotatably mounted on a fixed pin projecting horizontally outwardly from the mounting bracket. The shaft is formed with outer helical or spiral drive. A rope member is wound within the sheave and spring-loaded to a wound position. The rope extends from the lower periphery of the sheave outwardly through the front of the cowl. A pinion gear includes a hub member with an internal complementing spiral or helix mating with the drive shaft and held thereon by an outer clamp member. The pinion gear moves outwardly into engagement with a driven face gear formed on the lower, inner edge of the cup-shaped flywheel. The driven gear is formed within the inner portion of the flywheel flange to maintain a continuous smooth outer flywheel flange. A preload element is coupled to the pinion gear to prevent the free simultaneous rotation of the pinion gear with the drive shaft, while permitting the simultaneous rotation thereof after the pinion gear has moved to either extreme position on the shaft. Thus, a convenient system includes a small guide pin unit located within an opening in the pinion gear and slidably coupled to the clamping plate or cap such as by a U-shaped clip located within a peripheral groove in the cap.

The starter structure of this invention provides a rugged, reliable and relatively inexpensive rewind starter mechanism which can be advantageously located with respect to the engine and supporting structure for convenient pulling of the starting rope and further permitting optimum positioning with respect to the tilt axis of the engine in an outboard motor. The forming of the driven gear teeth within the lower face of the flywheel minimizes the exposure of the high-speed, whirling teeth on the flywheel to the operating personnel and equipment.

The present invention thus provides a reliable starter mechanism which can be readily adapted to aesthetically pleasing outboard motor constructions and the like.

BRIEF DESCRIPTION OF THE DRAWINGS

The drawings furnished herewith illustrate the best mode presently contemplated by the inventor for carrying out the subject invention in which the above advantages and features are clearly disclosed as well as others which will be readily understood from the following description of the illustrated embodiment.

In the drawings:

FIG. 1 is a side elevational view of an outboard motor secured to the rear transom of a boat;

FIG. 2 is an enlarged fragmentary front elevational view of a portion of the power head of the outboard motor with parts broken away to more clearly illustrate the construction of the illustrated embodiment of the present invention;

DESCRIPTION OF THE ILLUSTRATED EMBODIMENT

Figure 3:
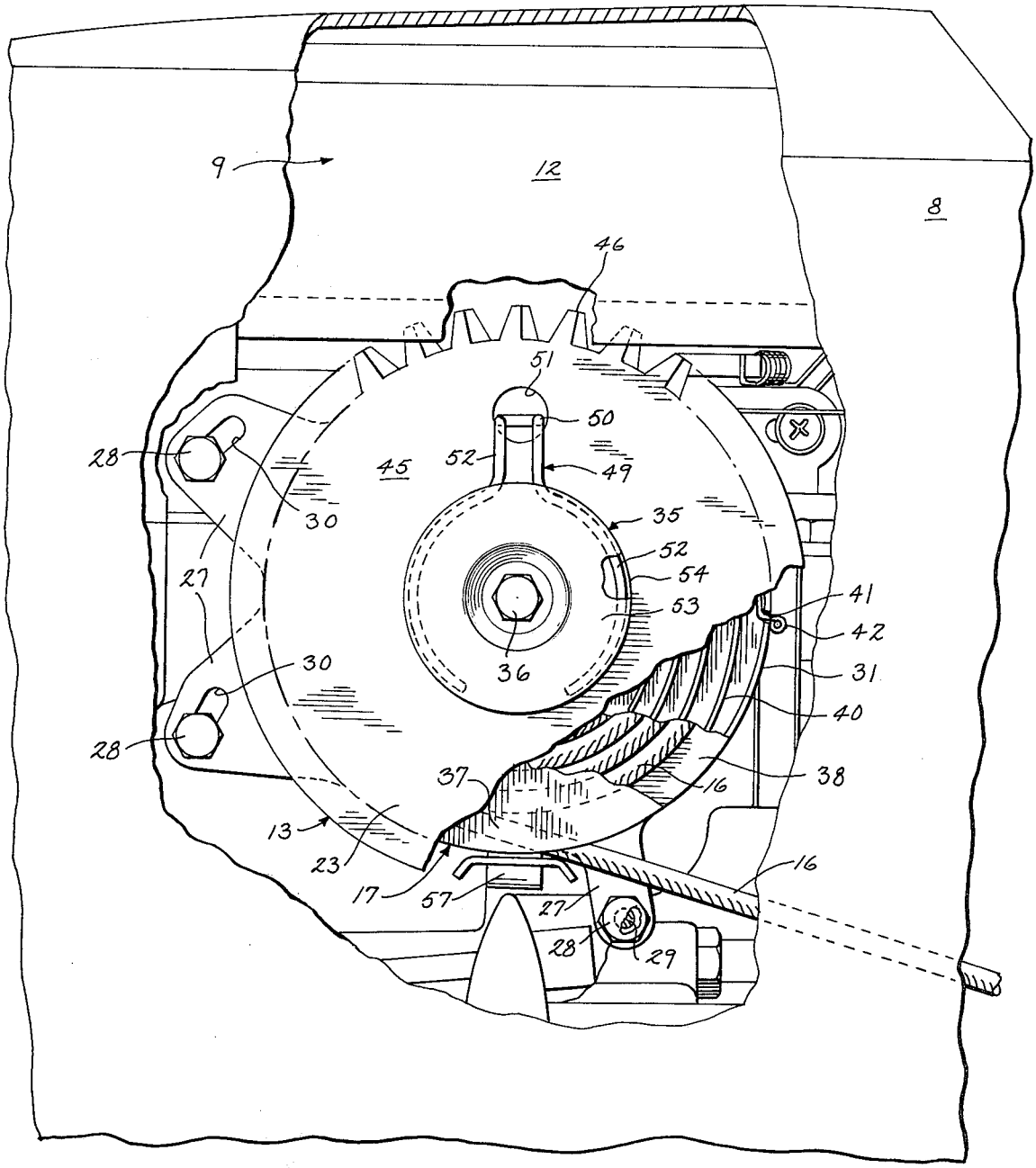
FIG. 3 is an enlarged fragmentary side elevational view with parts broken away and sectioned to further show the details of the illustrated embodiment of the invention.

Referring to the drawings and particularly to FIGS. 1 and 2 the present invention is shown applied to an outboard motor 1 of a generally conventional construction. The outboard motor 1 generally includes an upper powerhead assembly 2 carried by a drive shaft housing 3, the lower end of which is secured to a propeller unit 4. A pendant supporting clamp bracket 5 is connected to the drive shaft housing 3 immediately beneath the powerhead assembly 2 and secures the outboard motor 1 for tilting about a horizontal axis 5*a* as well as pivotal steering movement to a transom 6 of a boat or the like, not otherwise shown. The powerhead assembly 2 includes an internal combustion engine 7 suitably supported on the upper end of the drive shaft housing 3 and enclosed within a protective and decorative cowl 8 of any suitable construction. The cowl 8 is removably mounted about the engine 7 to permit removal and access to the engine 7 and associated component. The engine 7 is any suitable internal combustion engine. Conventionally, outboard motor engines include an upper engine cup-shaped flywheel 9 coaxially secured to the uppermost end of a crankshaft 10 as by a clamping nut 11 or the like. The depending flange 12 may cover a conventional alternator unit or the like having a stator 14 secured to the engine and a rotor 15 secured within the flywheel 9 to provide the electrical power for the engine and associated equipment.

In accordance with the teaching of the present invention, a unique starter assembly 13 is mounted to one side of the engine 7 immediately beneath the flywheel 9 and includes a starting line or rope 16 wound in a sheave 17. Rope 16 extends forwardly through the cowl compartment and exits through an opening 18 in the lower end of the front wall 19 of the cowl 8. A suitable handle 20 is secured to the end of the rope 16 for convenient pulling thereof and also prevents complete retraction of the rope 16 into the cowl 8 under a rewind spring mechanism 21 of the starter assembly 13 as hereinafter described.

Generally, the drive system of starter assembly 13 includes a rotatably mounted helix shaft 22 secured to the rope sheave 17 and rotating therewith. A pinion gear 23 includes a helix hub 24 on shaft 22 and adapted to move horizontally thereon into making engagement with a gear 25 formed on the inner edge of the lower face of the flywheel flange 12. After engagement, the positive rotation of the pinion gear 23 about the horizontal axis is transmitted to and affects the desired rotation of the flywheel 9 and interconnected crankshaft 10 for starting of the engine 7.

As illustrated in FIGS. 1 and 2, the present invention permits the convenient and aesthetic construction of the outboard motor with a relatively low profile and also permits the very convenient location of the rope 16 and the pulling force with respect to the swivel axis 5a of the swivel bracket 5. Thus, any forward force applied to the powerhead assembly 2 which tends to pivot the total unit about the swivel bracket axis 5a has a much shorter moment arm than if the force is located immediately adjacent to the upper end of the flywheel 9, in accordance with more conventional prior art construction. Ready access is available to the starter mechanism or assembly 13 by merely removing the side portion of the cowl 8 in any suitable manner. In conventionally small outboard motors, the total cowl 8 may be removed while in relatively larger horsepower units, the cowl 8 may be a multiple part assembly, for example, a clam-shell type construction. In either construction, the starter assembly 13 is conveniently located.

Referring to FIG. 3, the illustrated preferred embodiment of the novel starter mechanism 13 includes a generally flat mounting bracket 26 having three circumferentially spaced mounting projections or ears 27 with openings through which similar mounting bolts 28 firmly affix the starter assembly to the side of the engine. The one ear 27 has an opening 29 generally corresponding to the bolt 28 diameter while the other two ears have suitable slots 30 permitting the rotation of the total assembly about the mounting pivot bolt operning 29 for slight adjustment of the total assembly and particularly the pinion gear 23 with respect to flywheel gear 25. The mounting plate 26 is generally a circular disc member forming the back wall or otherwise secured to a separate back wall of a shallow cup-shaped spring housing 31 of the rewind mechanism 21.

A pivot pin 32 has an outer head 33 welded or otherwise rigidly affixed to the backside of the mounting plate 26 and extends outwardly through the mounting plate 26 and spring housing 31 to rotatably support the sheave 17 and gear 23.

The sheave 17 includes an offset hub portion 34 which projects into the spring housing 31 and includes an inner bearing end abutting the inner face of the spring housing 31. The offset hub 34 is integrally formed with the helix shaft 22 and is rotatably mounted on the bearing pin 32. The shaft 22 of the sheave 17 is rotatably retained upon the pin 23 by an outer cap 35 secured to the outer end of the shaft by a suitable cap screw 36.

The sheave 17 further includes a generally flat rope housing portion 37 with a peripheral rope groove 38. The rope 16 is wound within the groove as a single layer coil with the inner end secured in place by a small drive pin 39 extending through the opposite walls of the housing portion adjacent the innermost ends of the groove 38 and passing through the rope to anchor the inner end of rope 16. A flat coil spring 49 is wound about the sheave hub portion 34 within the housing 31. The inner end of the coil spring 40 is affixed to the hub portion 34 and the outer end is secured to the outer wall of the housing 31. In the illustrated embodiment, the outer end of the flat, band spring 40 extends through a slot 41 in the sidewall of housing 31 with an outer rolled head 42. The opposite end of the coil spring 40 is similarly secured to the drive hub portion 34 as by an inwardly bent lip 43 abutting an offset recess wall 44 thereon. The pulling and unwinding of the rope 16 is thus transmitted to and winds up the coil spring 40, such that upon release, the coil spring 40 unwinds and reverses the rotation of the sheave 17 to wind the rope 16 within the sheave groove 38.

The pinion gear 23 includes the inner hub 24 complementing and mating with the helix shaft 22. The pinion gear 23 includes a plate-like gear member 45 integrally attached to the outer end of the hub 24 and extending outwardly in overlying relation to the rope sheave 17. The gear teeth 46 are formed on the peripheral edge of the pinion gear member 45 with the uppermost gear teeth aligned with the gear teeth 47 of driven gear 25 on the flywheel flange 12.

The teeth 47 on the flywheel may be slightly shaped at the inner entrance end to promote smooth engagement with the gear teeth 46 regardless of the relative position of the flywheel relative to the gear plate.

In the illustrated embodiment of the invention the gear teeth 47 are an integral part of the flywheel 9 and are formed as downwardly extending teeth projecting laterally from and attached to the inner wall of the flywheel flange 12, so that the outermost wall of the flange 12 defines a continuous protective wall 48 enclosing the outer periphery of gear 25. This is desirable to maintain maximum protective enclosure of the mating teeth portion of the starter and thereby minimizes possible danger to adjacent operating personnel and equipment. Thus, any object engaging the side of the flywheel is protected from the mating teeth by the smooth outer wall.

The pinion gear 23 rotates with the sheave 17 and moves axially between engaged and disengaged positions in response to the pulling on the rope 16 and the automatic return thereof under the action of the coil spring 40. The rotation of the pinion gear 23 is slightly retarded or loaded by a preload unit 49 to prevent direct simultaneous initial rotation between the pinion gear and the rope shaft. The slight retarding of the rotation of the pinion gear 23 relative to the rotation of the drive shaft causes it to move axially on the helical threads.

In the illustrated embodiment of the invention, the preload unit includes a wire spring member 50 generally in the form of a hairpin and projectint axially into an opening 51 in the gear member 23 at a point radially offset from the axis of rotation. The spring member 50 extends axially of the pinion gear web 45 and bends ninety degrees forming a U-shaped wire clip 52 at its outer end. The clip 52 extends radially into coupled sliding relationship to the cap 35.

Figures 4, 5:
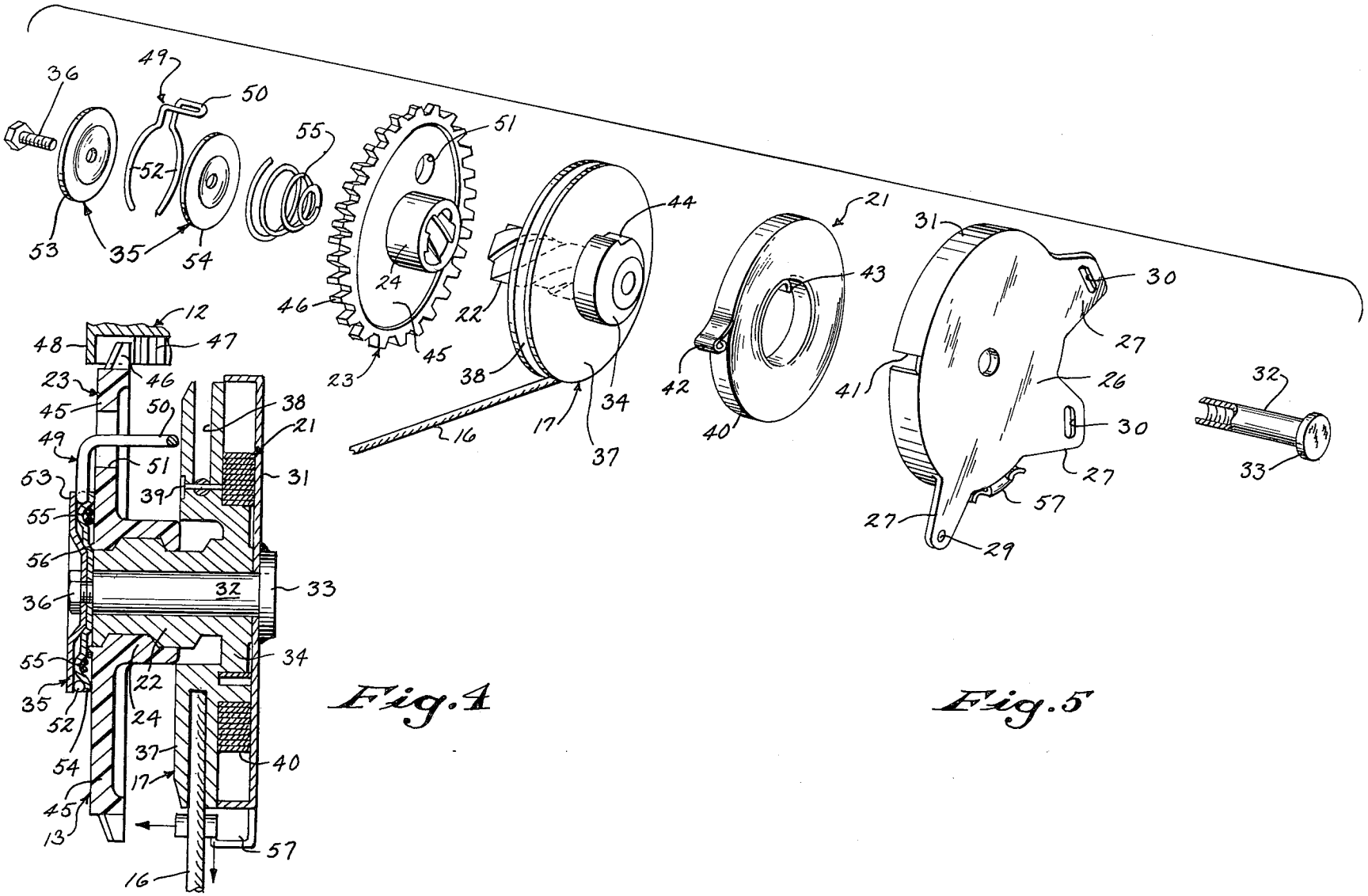
FIG. 4 is an exploded view of the starter mechanism and more clearly illustrating the detail of the individual components.
FIG. 5 is a vertical section of the starter apparatus similar to FIG. 2 with the rope extended and the starter in the drive position.

As most clearly shown in FIGS. 2 and 4, the cap 35 may be formed of a pair of spaced metal discs 53 and 54 with the outer edge deformed to define a groove within which the spring arms of the clip 52 are slidably located. The arms of clip 52 are stressed slightly to oppose or load the rotation of the unit and the pinion gear 23. When the shaft 22 rotates, the pinion hub 24 and pinion gear 45 will tend to rotate directly therewith. The initial rotation of the sheave 17, however, essentially immediately effects engagement of the edge of the opening 51 with the pin 50 which tends to retard its rotating movement. The interaction causes gear hub 24 to advance along the helical shaft 22 against the force of a light stabilizing spring 55. Spring 55 is a relatively weak spring member which primarily holds the gear 23 against vibrational movement during motor operation. The gear 23 therefore moves outwardly until either the outer end of the hub 24, which is provided with a suitable annular bearing 56, engages the undersurface of the cap 35, or the pinion gear teeth do not line up with flywheel gear teeth 25 so that outward movement of the pinion gear 23 stops. Further rotation of sheave 17 will cause a corresponding rotation of pinion gear 23 until pinion teeth 45 line up with flywheel gear teeth 25 at which time pinion gear hub 24 will again advance outwardly along helical shaft 22. Thereafter, the rotational force of the sheave 17 is directly transmitted to the gear 23 to effect the starting of the internal combustion engine.

When the rope 16 is released, an opposite rotation is effected under the action of the rewind spring 40. The reverse rotation of the shaft 22 is transmitted to the pinion gear 23 which tends to rotate directly with the shaft. However, the opening 51 engages with the opposite side of the pin 50 which again retards the simultaneous rotation, causing the gear 23 to rapidly move to the opposite disengaged position as shown in FIG. 2. Similarly, should the engine start prior to the release of the rope 16, the rapid rotation of the flywheel assembly 9 will effect the reverse disengagement movement of the gear 23 and hub 24 of the shaft 22.

The mounting plate 25 is shown formed with a suitable offset lip 57 providing a rope guide adjacent to and slightly spaced from the outer periphery of the sheave 17 and particularly groove 38. The offset lip 57 is generally a strap-like outer portion aligned with the peripheral edge of the sheave with the opposite ends thereof bent outwardly to provide a smooth guide surface as the rope moves onto and from the sheave.

In summary, in operation the rewind starter apparatus is mounted to the side of the engine 7 with the mounting plate 25 pivotally adjusted to locate the uppermost teeth 45 of the gear 23 in the plane of the flywheel teeth 47 and particularly to allow the free and full movement of the gear plate 23 with respect to the flywheel flange 12 while maintaining maximum teeth engagement.

Pulling on the rope handle 20 causes the unwinding of the rope 16 with the simultaneous rotation of the rope sheave 17 and interconnected drive shaft 22. The preload unit 49 prevents the simultaneous free rotation of the gear hub 24 which moves outwardly on the splined shaft 22 carrying the gear 23 outwardly. The gear 23 mates with the starter gear 25 on the underside of the flywheel assembly 9 as the gear plate 45 moves outwardly into bearing engagement with the cap 35. Thereafter, the total unit rotates to transmit rotation to the flywheel assembly 9 and thus to the engine crankshaft 10, which, with appropriate fuel and power supplied to the engine 7, will ignite and operate the engine.

Various modes of carrying out the invention are contemplated as being within the scope of the following claims, particularly pointing out and distinctly claiming the subject matter which is regarded as the invention.

I claim:

1. In combination with an internal combustion engine having a starter member secured to the engine crankshaft and having an outer wall located laterally outwardly of the engine, a starter assembly having mounting means for securement to the side of the engine beneath said starter member and comprising, a drive member rotatably mounted immediately adjacent to the engine and having a rotating axis generally normal to the axis of the starter member and movable outwardly from the engine into driving engagement with the starter member, and means to rotate the drive member to move the drive member outwardly into and inwardly from engagement with said starter member to rotate the starter member and crankshaft for starting of the engine.

2. In the combination of claim 1 wherein said drive member is a gear having peripheral teeth and a rotatably mounted shaft, a driven member including a driven shaft telescopes with said gear shaft and coupled by a spiral thread means, means coupled to the driven member to effect rapid rotation of the driven member and thereby cause said drive member to move outwardly into engagement with said starter member.

3. In the combination of claim 2 including a mounting bracket having an outwardly projecting pin member, said driven shaft being rotatably mounted thereon, and said bracket having adjustable mounting means for accurate location of the drive member relative to the starter member.

4. In the combination of claim 1 wherein said starter member is an inverted cup-shaped flywheel having a gear secured to the lower edge of the outer wall of the flywheel, said gear being formed inwardly of the outermost surface of the outer wall to maintain an outer covering of said gear, said gear having laterally opening gear teeth, said drive member is a plate-like gear rotatably mounted on a generally horizontal axis and having peripheral gear teeth for movement into engagement with the flywheel gear.

5. In the combination of claim 4 wherein said starter assembly includes a mounting bracket having a plurality of mounting ears including mounting slots, bolt means passing through said mounting slots and firmly affixing the bracket to the engine, said slots permitting limited angular orientation of said bracket for positioning the drive plate-like gear relative to said flywheel gear.

6. In combination, an internal combustion engine with a top-mounted inverted cup-shaped flywheel rotatably secured to the engine crankshaft, a starter assembly secured to the side of the engine beneath said flywheel, said flywheel having a gear means thereon and comprising, a mounting bracket means releasably secured to the engine, a pivot pin means secured to the bracket means and projecting horizontally outwardly of the engine, a manual driven plate-like rope sheave with a generally radial rope groove rotatably mounted on said pivot pin means beneath said flywheel and including a helical drive shaft means, a drive rope wound within the sheave and operable to rotate the sheave in response to a pull on said rope, a starter gear means beneath said flywheel and having a helically driven hub means on said shaft means and movable axially on said shaft means in accordance with the rotation of said means, a stop cap means secured to the outer end of said pivot pin means to limit the outward movement of said gear means, a driven gear means secured to the lowermost edge of said flywheel, said driven gear means including peripheral gear teeth adapted a mate with said starter gear means in response to outward movement of the starter gear means to transmit rotation to the flywheel and engine crankshaft, a resilient return means coupled to said rope sheave to reset the sheave with the rope wound therein.

7. In the combination of claim 6 wherein said driven gear means includes downwardly facing gear teeth formed only on the inner wall of said flywheel flange to maintain an outer enclosure of said gear by the outer portion of said flange.

8. In the combination of claim 6 wherein said mounting bracket includes a plurality of mounting openings including elongated slots to provide limited angular orientation of the bracket, said rope sheave having a central shaft rotatably mounted upon said pivot pin means and having said shaft projecting axially in opposite directions from the sheave, and engaging said bracket at the inner end, said resilient return means including a coil spring encircling the shaft adjacent the bracket and secured at the opposite ends to the shaft and to the bracket, said cap means having a peripheral groove, a preload unit including a clip having arms resiliently located within the groove and an offset pin means extending through an opening in said starter gear means, and a light coil spring means encircling the hub between said starter gear means and said cap means.

9. In the combination of claim 8 wherein said bracket includes an outer annular wall encircling and enclosing said coil spring, said rope sheave having an outer diameter corresponding to said annular wall and being slightly spaced therefrom, and said starter gear means having an outer diameter corresponding to said annular wall and being slightly spaced from the rope sheave in the standby poisition of the starter assembly.

10. A starter apparatus for an internal combustion engine having a cup-shaped spring housing with a base plate and an outer peripheral wall means, a plurality of mounting tabs secured to said wall means at least one of which is formed with a pivot bolt opening and the other of which includes bolt slots, a pivot pin secured to said wall means and projecting axially outwardly of said wall means, a plate-like rope sheave having a shaft rotatably mounted on said pin and including a hub portion abutting said wall means and including an outer spiral thread portion, said rope sheave having a radial rope groove, a rope wound within said groove with the inner end secured to the sheave and the outer end extending from the sheave, a flat gear having a hub with an internal spiral thread portion mating with said thread portion of the sheave shaft, said hub being shorter than said shaft and moving axially outwardly from said housing and inwardly in response to rotation of said shaft, said gear having peripheral drive teeth, and a stop means secured to the outer end of said shaft to limit the outward movement of said hub.

11. The starter apparatus of claim 10 wherein said stop means includes a disc-like member having a circumferential groove coaxial of said shaft, a member located within the groove and frictionally engaging the groove, said member extending from the groove and coupled to said gear to slightly retard rotation of the gear relative to said shaft.

12. The starter apparatus of claim 11 wherein said gear has an axially extended opening and said member projects into said opening.

13. The starter apparatus of claim 11 wherein said member includes a U-shaped clip with side arms located within said groove and resiliently gripping the groove and an offset pin extending axially inwardly into an opening in said gear, a light coil spring located between the gear and the stop means to prevent vibratory movement of the gear in the standby position of the starter apparatus.

14. In an outboard motor having an internal combustion engine with a top-mounted inverted cupshaped flywheel rotatably secured to the engine crankshaft, a starter assembly secured to the side of the engine beneath said flywheel and comprising, a manually operated drive means rotatably mounted to the one side of the engine with a generally horizontal axis of rotation and including a rotating helical means, a starter driven means immediately adjacent said drive means beneath said flywheel and having a helical means on said rotating helical means and movable axially thereon in accordance with the rotation of said drive means, an engine drive means secured to the lowermost edge of said flywheel, said drive means including a peripheral element adapted to mate with said engine drive means and driven in response to outward movement from said engine of the starter driven means to transmit rotation to the flywheel and engine crankshaft, a resilient return means coupled to said drive means to reset the driven means.

15. In the outboard motor of claim 14 having a mounting bracket means releasably secured to the engine, a pivot pin means secured to the bracket means and projecting horizontally outwardly of the engine, said helical means including a hollow shaft rotatably mounted on said pivot means, said helical driven means including a tubular hub mounted on said shaft, and a stop means secured to the outer end of said pivot pin means to limit the outward movement of said starter driven means.

16. In the outboard motor of claim 14 wherein said engine drive means and said peripheral element are gear members, the gear member on said flywheel having downwardly facing gear teeth formed only on the inner wall of said flywheel flange.

17. In the outboard motor of claim 14 having a swivel mounting bracket located beneath the engine, said manually operated drive means including a rope sheave means with a rope wound therein, said rope extending outwardly from the lower end of the rope sheave means to locate the force adjacent to the swivel mounting bracket.

18. In the outboard motor of claim 14 having a mounting bracket including a plurality of circumferentially distributed mounting openings including elongated slots to provide limited angular orientation of the bracket, said starter drive means including a rope sheave rotatably mounted upon said bracket and having said shaft projecting axially in opposite directions from the sheave, said rope sheave having a peripheral, radially extended rope groove, a rope wound within the sheave groove with the inner end secured to the sheave, a coil spring encircling the shaft adjacent the bracket and secured at the opposite ends to the shaft and to the bracket, said starter driven member being a starter gear having a hub mounted on said shaft, said shaft and hub having complementing engaged helical threads, and a stop means secured to said shaft to limit the outward movement of said starter gear, and a coil spring means encircling the hub between said starter gear and said cap.

19. The apparatus of claim 18 wherein said stop means includes a disc-like member secured to the shaft and having a peripheral groove, a preload unit including a clip having arms resiliently located within the groove and an offset pin means extending through an opening in said starter gear.

20. The apparatus of claim 19 wherein said outboard motor includes a swivel mounting bracket located beneath the engine, and said rope extends from the lower end of the rope sheave to locate the pull force on the rope adjacent to the bracket.

21. A flywheel for securement to the upper end of a vertical crankshaft, comprising a base portion having a central opening to receive a crankshaft and having an outer depending annular flange, a gear secured within the lower edge of the flange and inwardly of the outer surface of the flange to maintain an outer enclosure of the gear.

* * * * *

UNITED STATES PATENT AND TRADEMARK OFFICE

CERTIFICATE OF CORRECTION

PATENT NO. : 3,952,718
DATED : April 27, 1976
INVENTOR(S) : JAMES A MEYER

It is certified that error appears in the above-identified patent and that said Letters Patent are hereby corrected as shown below:

Column 5, Line 43, after "spring" cancel "49" and insert --- 40 ---;

Column 8, Line 38, after "said" insert --- shaft ---;

Column 8, Line 45, after "adapted" cancel "a" and insert --- to ---;

Signed and Sealed this

Fourteenth Day of September 1976

[SEAL]

*Attest:*

RUTH C. MASON
*Attesting Officer*

C. MARSHALL DANN
*Commissioner of Patents and Trademarks*